US009774139B1

(12) United States Patent
Dominique

(10) Patent No.: US 9,774,139 B1
(45) Date of Patent: Sep. 26, 2017

(54) CONTROLLED SHEAR POINT WIRING ADAPTER

(71) Applicant: Jeffrey Michael Dominique, Phoenix, AZ (US)

(72) Inventor: Jeffrey Michael Dominique, Phoenix, AZ (US)

(73) Assignee: Jeffrey M. Dominique, Phoenix, AZ (US)

( * ) Notice: Subject to any disclaimer, the term of this patent is extended or adjusted under 35 U.S.C. 154(b) by 0 days.

(21) Appl. No.: 14/999,035

(22) Filed: Mar. 22, 2016

(51) Int. Cl.
*H01R 13/635* (2006.01)
*H01R 9/24* (2006.01)

(52) U.S. Cl.
CPC ..... *H01R 13/635* (2013.01); *H01R 9/24* (2013.01); *H01R 9/2408* (2013.01); *H01R 9/2416* (2013.01)

(58) Field of Classification Search
CPC ..... H01R 13/635; H01R 9/24; H01R 9/2416; H01R 9/2408
USPC .... 439/155, 476.1, 483, 723, 724, 721, 794, 439/790, 923
See application file for complete search history.

(56) References Cited

U.S. PATENT DOCUMENTS

| | | | | |
|---|---|---|---|---|
| 2,761,111 | A | 8/1956 | Klostermann | |
| 3,328,743 | A * | 6/1967 | Acord | H01R 13/635 285/86 |
| 6,910,911 | B2 * | 6/2005 | Mellott | H01R 13/2421 439/180 |
| 8,267,594 | B2 * | 9/2012 | Wouters | G02B 6/389 385/53 |
| 8,515,233 | B2 * | 8/2013 | Dominique | G02B 6/00 385/134 |
| 8,764,309 | B2 | 7/2014 | Wouters | |

* cited by examiner

*Primary Examiner* — Hae Moon Hyeon
*Assistant Examiner* — Justin Kratt
(74) *Attorney, Agent, or Firm* — Steve Funk

(57) ABSTRACT

A wiring adapter is provided which controls the shear point for a wiring system in a traffic control box and other electrical panels. The wiring adapter includes a bottom segment which is securely mounted in the control box. Incoming wires to the control box are connected to the bottom segment. The top segment of the wiring adapter includes connections for wires running from the wiring adapter to the power or control elements in the control box. The wiring adapter uses a quick release retention mechanism to secure the top segment to the bottom segment. When a triggering event occurs, the quick release mechanism separates the top segment from the bottom segment to ensure that the shear point for the wiring system occurs at the wiring adapter.

19 Claims, 14 Drawing Sheets

CONTROLLED SHEAR POINT WIRING ADAPTER

BACKGROUND

This invention pertains to controlled shear point adapters for mounting and connecting electrical wires and fiber optic cables. More particularly, this invention pertains to a controlled shear point wiring adapter with an anchored bottom segment and a quick release top segment. The wiring adapter is positioned in a control box or other mounting cabinet structure to facilitate the connection of various wires utilized in the structures, such as the power wires from a power source to the control box or the control wires from the control box to external control elements. When a physical stress is placed on the wiring system, the quick release function of the wiring adapter is triggered to separate the top segment from the bottom segment, such that the shear point of the wiring system occurs at the wiring adapter.

The power systems utilized in the control boxes or other mounting cabinet structures will typically require physical wires that provide connectivity to a source of power. The control systems will also have significant wiring requirements to provide connectivity between the control elements in the control boxes and the external control elements and sensors. Fiber optic cables may be used for traffic monitoring and control, as well as road structure monitoring, where communicating information to a traffic management center or other control center via a fiber optic communication system is advantageous. The physical wires and fiber optic cables may be buried in the ground or run behind walls or mounted on poles above ground level. In many situations, it is difficult to access or repair the physical wires in the event that the wires are damaged.

In a control box, stable junction connections between terminals in a power system or control system are preferred. The connection requires that the terminals be properly aligned and held steady during operation in a clean connection. These connections are susceptible to damage caused by sudden motion. Sudden motion may damage the physical wires by pulling, tearing, or breaking the physical wires.

The physical wires are generally made up of a plurality of segments connected together through junctions. In many applications where a junction is use to connect a first terminal is connected to a second terminal, a rigid connection is required. The advantage of a rigid connection is that it promotes the connection between the first terminal and the second terminal with transmission mediums such as electrical signals, power supplies, or fiber optic light waves. The disadvantage of such a connection is that any force applied to the connection may result in damage to the physical cable connected by the junction. In order to avoid damage caused by forces applied to the junction, a quick release mechanism is available to provide the advantages of a physical connection between the first and second terminal while allowing for a quick release of the first terminal from the second terminal in the event of a force being applied to the junction.

For both the outdoor and in-building control box installations, the wires are often placed in conduit or other ducts. The conduit provides protection for both physical and environmental abuse. In underground installations, the conduit protects the cable from shifting rocks, aggressive rodents, digging equipment, and other hazards. In metropolitan areas, multiple conduits are often grouped as duct banks to accommodate future growth of the wiring infrastructure without major traffic disruptions from cutting and trenching of the streets.

Control boxes are used extensively in the transportation industry for various traffic control and road monitoring applications. The control boxes are generally mounted along the edge of the highway or local streets in proximity to the location of the traffic signals or other traffic control or monitoring elements. One of the most expensive problems in operating such systems is to repair damages to the wiring systems caused by traffic accidents which physically damage the control boxes. The wiring connections inside the control boxes are often ripped apart and destroyed. The physical wires, which are in a conduit buried under ground or mounted on a pole, are damaged within the conduit. In such a case, the wiring may need to be re-laid from the source to the destination. The process of replacing wiring connectors and relaying the physical wires is time consuming, labor intensive, expensive, and dangerous. The longer an intersection is disabled for repair work, the more likely it is for secondary accidents to occur.

In order to minimize the damage caused by sudden physical stress to a wire, it is desirable to control the shear point, which is the point at which the wires break when sufficient stress is applied. When the wiring system is stressed, the quick-release function of the wiring adapters ensures that the shear point occurs at the adapter and not elsewhere in the wiring system. By controlling the shear point, damages to the wiring system caused by a physical stress are limited, and the time and expense for repairs are drastically reduced.

Another concern when a control box is damaged in a traffic accident or other incident is an exposed power wire. When the wires are ripped apart in the accident, one end of the wires will still typically be connected to a power source. Although the power source may have an electrical circuit breaker in the system, the circuit breaker may not always trip when the wires are damaged. Any exposed live wires at the scene of the accident may be an electrical hazard to any persons at the scene of the accident. When a stress occurs in the wiring system and the top segment of the wiring adapter is separated from the bottom segment, the exposed ends of the power wires are still retained in the lower adapter segments, thereby reducing the danger caused by exposed wires. The electrical connectors on the lower adapter segment are recessed to prevent accidental human contact.

The control boxes for traffic control and many other applications, such as street light poles, dynamic message boards, school crossing lights, and speed monitoring poles, are mounted outdoors. When torrential rain or snow storms occur, the inside of the control boxes may have standing water, which may damage the wiring systems and create an electrical hazard for persons around the control boxes. The controlled shear point wiring adapter of the present invention is a sealed adapter such that the adapter continues to function when exposed to standing water.

Wiring damages caused by control box accidents are also a concern in industries other than the transportation industry. Control boxes are used in other outdoor and indoor applications where the wires are positioned in underground conduits or other conduit locations where wire repairs would be difficult. For example, street light poles, which typically have underground power wires but no control wires, frequently have damage to the power wires caused by traffic accidents.

SUMMARY

Embodiments of the invention are defined by the claims below, not this summary. A high-level overview of various aspects of the invention are provided here for that reason, to provide an overview of the disclosure, and to introduce a selection of concepts that are further described in the detailed-description section below. This summary is not intended to identify key features or essential features of the claimed subject matter, nor is it intended to be used as an aid in isolation to determine the scope of the claimed subject matter.

The present invention includes a controlled shear point wiring adapter with a quick release function, which is used to connect wires being connected in a control box or other application. The wiring adapter includes a top segment and a bottom segment which are provided as separate components for mounting in the control box. The bottom segment includes an anchor system to secure the bottom segment to the concrete floor of the control box or other device. The bottom segment is mounted in proximity to the open end of a conduit used to deliver power wires or control wires to the control box. The wires extending from the conduit are connected to terminals in the bottom segment of the wiring adapter. The wires extending from the controller in the control box or other similar devices are connected to the top segment. The top segment and bottom segment include conductor lugs and an alignment mechanism to facilitate proper connectivity and alignment between the top and bottom segment.

Once the wires have been connected to the top segment and the bottom segment, the two segments are connected in the control box. A spring is positioned between the top segment and the bottom segment. When the segments are connected the spring is compressed to store potential energy. One or more quick release retainer clips are used to hold the segments together and compress the internal o-rings. A trip ring or other trigger mechanism is connected to the top segment, and one or more trip wires are connected between the trip ring and anchors or other fasteners in the control box or other similar device. When an accident occurs and the control box is being damaged, the physical stress will cause the trip wire to be moved, which will pull the trip ring. When the trip ring is pulled, the retainer clips release and the energy of the spring, combined with any additional energy from the moving of the control box as a result of the accident, cause the top segment to vertically separate from the bottom segment, thereby causing the shear point of the wiring system to occur at the location of the wiring adapter.

In an embodiment, the top segment may be formed by two plates, a top outer backing plate and a top connector plate. The bottom segment may also be formed by two or more plates, including an outer bottom backing plate and a bottom connector plate. One of the connector plates will have female lugs or other types of connectors, and the other connector plate will have the corresponding male lugs or other types of connectors. After the bottom segment is secured near the conduit bringing wires to the control box, the top connector plate is aligned with the bottom connector plate and the upper male lug is inserted into the lower female lug to provide the electrical connection.

BRIEF DESCRIPTION OF THE SEVERAL VIEWS OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views. While several embodiments are described in connection with these drawings, the disclosure is not limited to the embodiments disclosed herein. On the contrary, the intent is to cover all alternatives, modifications, and equivalents. Illustrative embodiments of the present invention are described in detail below with reference to the attached drawing figures, and wherein.

DETAILED DESCRIPTION

The subject matter of embodiments of the present invention is described with specificity herein to meet statutory requirements. But the description itself is not intended to necessarily limit the scope of claims. For the purpose of teaching inventive principles, some conventional aspects of the best mode may be simplified or omitted. Note that some aspects of the best mode may not fall within the scope of the invention as specified by the claims. Thus, those skilled in the art will appreciate variations from the best mode that fall within the scope of the invention. Those skilled in the art will also appreciate that the features described below can be combined in various ways to form multiple variations of the invention. As a result, the invention is not limited to the specific examples described below, but only by the claims and their equivalents. Although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

U.S. Pat. No. 8,515,233, entitled "Adapter for Mounting Cable Connectors," by Jeffrey Michael Dominique, is incorporated by reference herein in its entirety.

Figure 1:
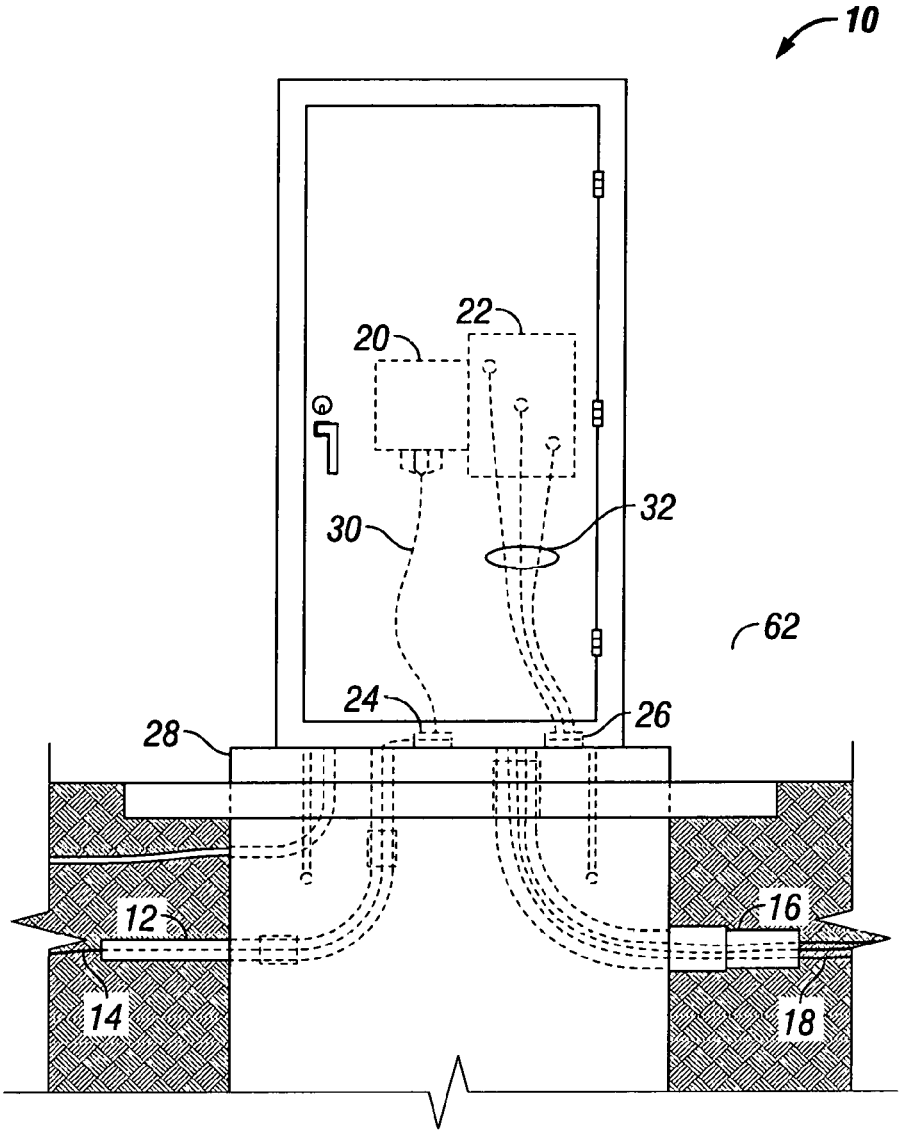
FIG. 1 shows a control box which is used for traffic control and road monitoring, said control box including two conduits entering the bottom of the control box: (i) a power wire conduit with a power wiring adapter mounted in proximity to the conduit opening at the bottom of the control box, and (ii) a control wire conduit with a control wiring adapter mounted in proximity to the conduit opening at the bottom of the control box.

Referring now to FIG. 1, a control box 10 provides an enclosure mounted on a concrete pedestal 28. For traffic and road monitoring applications, the control box 10 is typically positioned on the side of the road at an intersection or other strategic location. Similar control boxes may be used for other control transmission or power transmission applications. The control box 10 includes two conduits entering the control box. For traffic control applications, the first conduit 12 contains power wire 14 to provide 120 volt or 240 volt electrical power to the control box 10. The second conduit 16 contains low voltage control wires 18. The control wires 18 may be used to send electrical control signals between the traffic light signal devices, video cameras, crosswalk systems, pavement sensors, and other traffic or road devices (not shown), which are mounted in proximity to the control box 10. The power system components 20 and the control system components 22 are positioned in the control box 10. The conduits 12, 16 could also enter the side or top of control box 10 for special traffic locations or for control boxes in industries other than traffic control and monitoring.

One of the problems faced by state and local governments in maintaining traffic control boxes 10 mounted along a street is the damage caused to the control boxes 10 by traffic accidents or other impact accidents. After an accident, the control box 10 itself and the power system components 20 and the control system components 22 may need to be replaced. But the costs are increased significantly if the power wire 14 or control wires 18 are damaged in an accident. If the power wire 14 or control wires 18 are ripped apart or otherwise damaged, such wires will need to be replaced. This often involves significant digging with special equipment, pavement repair work, and other costly repair services to reestablish the connections.

In addition to traffic control boxes, the power wiring adapter and the control wiring adapter can be used in other devices and applications where controlling the shear point of a stressed wiring is beneficial, such as production equipment, power supplies, and applications where wires extend through a concrete pedestal. For example, street light poles only have power wires extending from a concrete pedestal and do not typically have any control wires. A power wiring adapter could be mounted at the base of the light pole to control the shear point of the power wires if the light pole is damaged in an accident.

In FIG. 1, the power wiring adapter 24 and the control wiring adapter 26 are mounted on the concrete pedestal 28 in proximity to the openings of conduit 12 and conduit 16, respectively. The power wire 14 may be any type of power wires used to deliver alternating current power to the power system components 20 in control box 10. The power wire 14 may be twisted copper wires having an outer jacket to protect the inner conductors (not shown). The three inner conductors are usually insulated copper conductors twisted around a flexible core. The three conductors include a hot—power conductor, a common—neutral conductor, and a ground wire. The power provided by the power wire 14 is typically 120 volts, 60 Hz, single phase. When the power wire 14 exits the conduit 12, the power wire is cut by the installer—technician and the three conductors in the power wire 14 are connected to the bottom segment of the power wiring adapter 24. Then a power wire segment 30 is connected between the top segment of power wiring adapter 24 and the terminals for the power system components 20.

The control system components 22 may include a power converter to convert the AC power to direct current power or to low voltage AC power, such as 24 volts DC or AC or 12 volts DC or AC. The logic portion of the controllers utilize the direct current power or low voltage AC power to send and receive traffic light power or control signals from the sensors, detectors, light switches and other control components. The control wires 18 are multi-conductor control wires. The control wires 18 may have anywhere from two conductors up to sixty total conductors, but most control wires 18 in the traffic control applications will have two to four conductors per interface device. The control wires 18 include an outer jacket to protect the inner conductors. The inner conductors are individually insulated and usually twisted around a center core. When the control wires 18 exit the conduit 16, the control wires are cut by the installer—technician and the conductors in the control wires 18 are connected to the bottom segment of the control wiring adapter 26. Then control wire segments 32 are connected between the top segment of control wiring adapter 26 and the terminals for the control system components 20.

FIGS. 2-9 show the configuration of the power wiring adapter 24 of the present invention. The power wiring adapter 24 may be made of any material, including non-conductive metal, plastic, or rubber. The preferred material and methodology for making the power wiring adapter 24 is a molded or machined, high density PVC plastic or other similar non-conducting material. The power wiring adapter 24 has two main components, a bottom segment 34 and a top segment 36. The bottom segment 34 includes three plates, a base plate 38, a bottom lug plate 40, and a center plate 42. The top segment 36 includes two plates, the top lug plate 44 and the cover plate 46. The power wiring adapter 24 is furnished to technicians in the field as a kit, with each of the five plates packaged individually within the kit for assembly at the control box 10.

Figure 2:
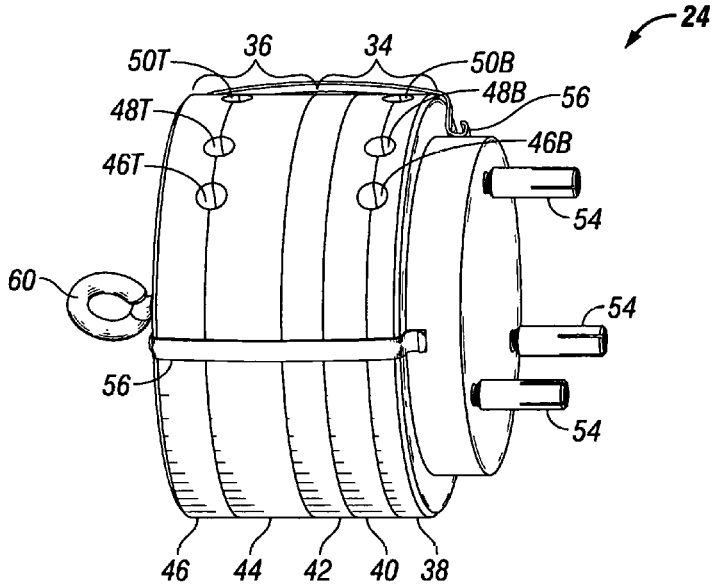
FIG. 2 is a bottom perspective view of the power wiring adapter with retention clips securing the top segment to the bottom segment of the power wiring adapter.
Figure 3:
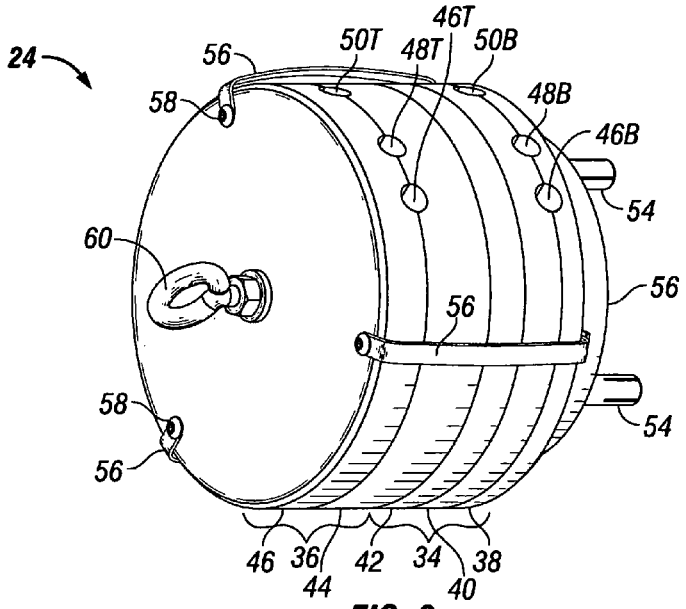
FIG. 3 is a top perspective view of the power wiring adapter with retention clips securing the top segment to the bottom segment of the power wiring adapter.

FIGS. 2-3 show the power wiring adapter 24 in assembled form. There are three horizontal apertures 46B, 48B, and 50B formed in the bottom segment 34 and three corresponding horizontal apertures 46T, 48T, and 50T formed in the top segment 36. When the power wire 14 exits the conduit 12, the outer coating at the end of the power wire 14 is stripped off and the insulation at the ends of the conductors is also stripped off by the technician. The insulated conductors include a hot—power conductor, a common —neutral conductor, and a ground wire. Each of the conductors is color-coded per the applicable electrical wiring standards. Each of the three conductors of power wire 14 is allocated to one of the apertures 46B, 48B, 50B for connection to electrical lugs on the inside of the power wiring adapter 24. The power wire segment 30 extending from the power system components 20 to the power wiring adapter 24 has the end of the segment 30 prepared in a similar manner for positioning in apertures 46T, 48T, and 50T of the top segment 36. For electrical continuity purposes, the conductors of power wire 14 positioned in the apertures 46B, 48B and 50B must match the corresponding conductors of the power wire segment 30 positioned in the apertures 46T, 48T and 50T. For example, if the hot—power conductor is positioned in aperture 46B, the hot—power conductor would also be positioned in 46T.

Three mounting bolts 52 extend from the bottom surface of base plate 38, which are used to secure the bottom segment 34 of the power wiring adapter 24 to the concrete pedestal 28 at the bottom of control box 10. Three holes are drilled into the concrete pedestal 28. The anchors 54 are inserted into the holes in the concrete. The plates 38, 40, 42, 44, 46 are assembled in the field at the time of installation. The mounting bolts 52 extend through the plates 38, 40, and 42 to secure the bottom segment 34 to the concrete pedestal 28. Alternative mounting bolts are available which are specifically designed for self-anchoring in concrete, and the concrete anchors 54 are not necessary to secure the bottom segment 34 to the concrete pedestal 28.

The retention clips 56 are used to secure the top segment 36 to the bottom segment 34. The retention clips 56 are fastened to the top of the cover plate 46 using screws 58 or other similar fasteners. The retention clips are made of aluminum or other flexible metal. The free end of the retention clips 56 includes a hook which is positioned to engage the flanged surface of the base plate 38. The retention clips 56 are sized so that the clips 56 have sufficient force to secure the top segment 36 to the bottom segment 34. The retention clips 56 also provide sufficient force to compress the o-rings 76, 78 to create a sealed, water barrier.

An adapter ring, such as anchor bolt 60, is secured in the top surface of the cover plate 46. One or more trip wires (not shown) are connected to the anchor bolt 60.

Figure 4:
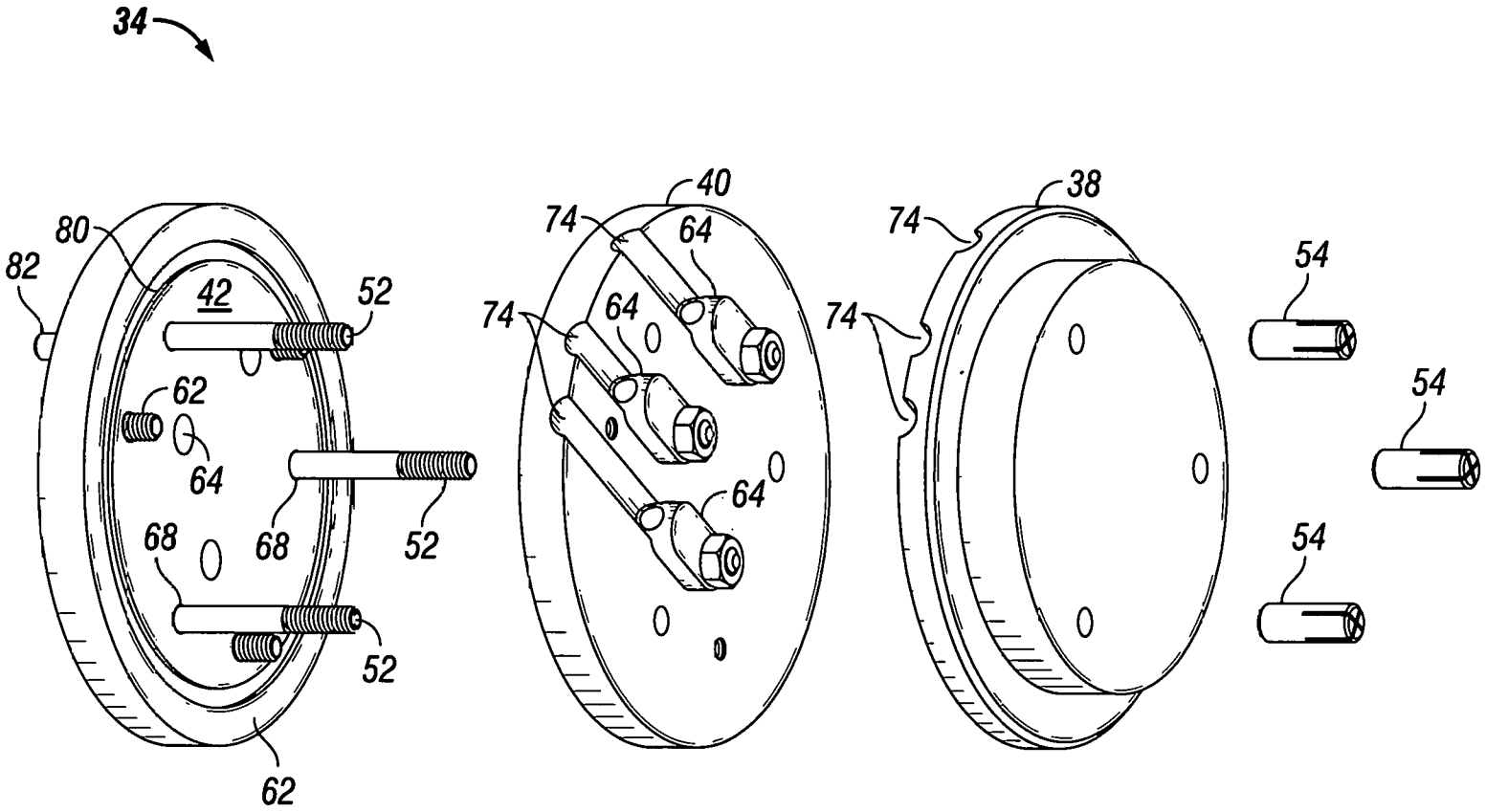
FIG. 4 is an exploded, bottom perspective view of the three plates of the bottom segment of the power wiring adapter.
Figure 5:
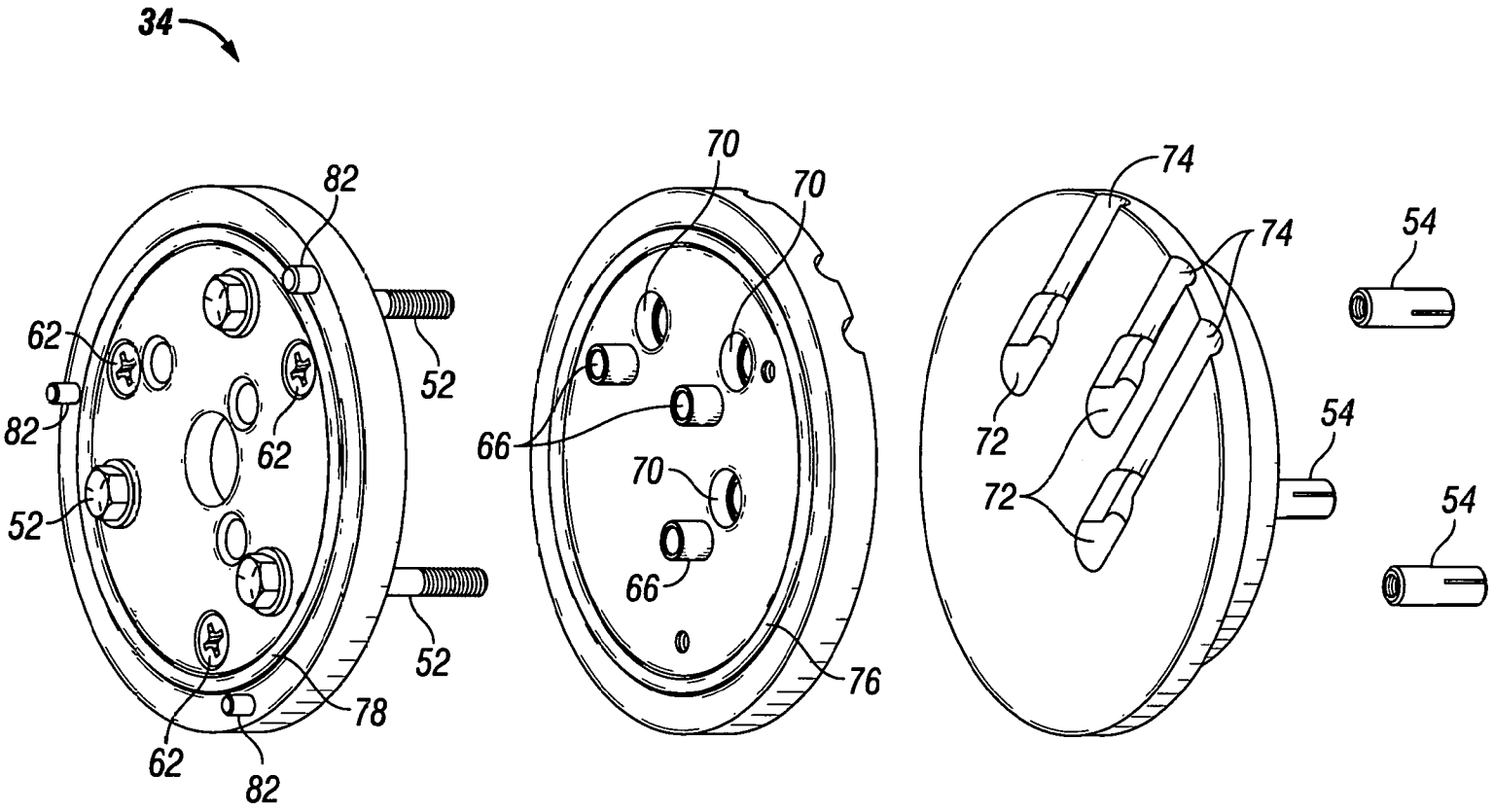
FIG. 5 is an exploded, top perspective view of the three plates of the bottom segment of the power wiring adapter.

FIGS. 4 and 5 provide an exploded view of the bottom segment 34. The mounting bolts 52 extend from the top of the center plate 42 through the bottom lug plate 40 and the base plate 38 into the anchors 54. The screws 62 are used to secure the center plate 42 to the bottom lug plate 40.

The electrical lugs 64 for the bottom segment 34 are mounted on the bottom side of the lug plate 40. Female lug extensions 66 extend from the upper surface of the lug plate 40 and into the lug apertures 68 on the center plate 42. The wire clamping element 70 is accessible from the upper surface of the bottom lug plate 40. When an electrical conductor is inserted into the lug 64, the clamping element 70 is screw tightened to secure the conductor in the lug 64. Lug recesses 72 are formed in the top of the base plate 38 and the bottom of the bottom lug plate 40 for positioning the lugs 64. Access grooves 74 are also formed in the top of the base plate 38 and the bottom of the bottom lug plate 40 to form the apertures 46B, 48B, and 50B to allow the electrical conductors to access the lugs 64.

A bottom o-ring 76 and a top o-ring 78 are positioned in circular grooves 80 formed in the top surface of the bottom lug plate 40, and in both the top and bottom surface of the center plate 42. The o-rings 76, 78 provide a water tight seal for the electrical conductors and lugs 64 on the inside of the power wiring adapter 24. Two small and one large positioning pins 82 are secured to the upper surface of the center plate 42. The positioning pins are used to assure proper electrical conductivity and mechanical alignment when the top segment 36 is secured to the bottom segment 34. The positioning pins 82 may be formed of varying diameters so that when the top segment 36 is secured to the bottom segment 34, the electrical polarity of the mated connectors is maintained as originally wired.

Figure 6:
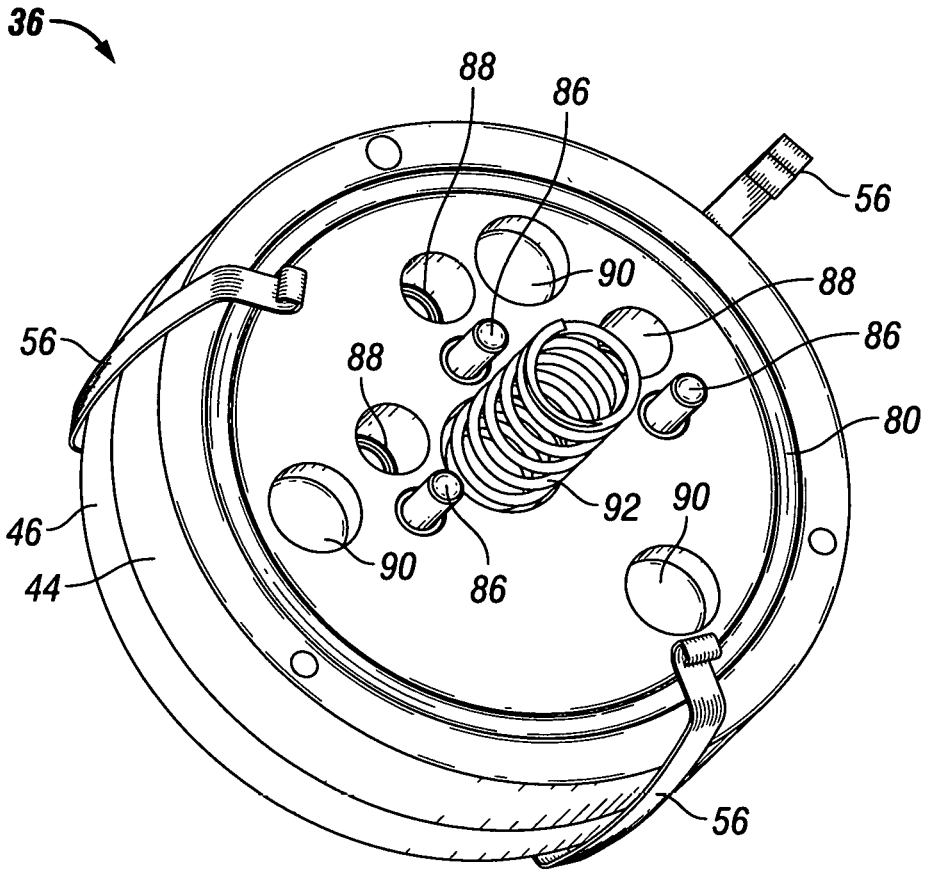
FIG. 6 is a bottom perspective view of the top segment of the power wiring adapter.
Figure 7:
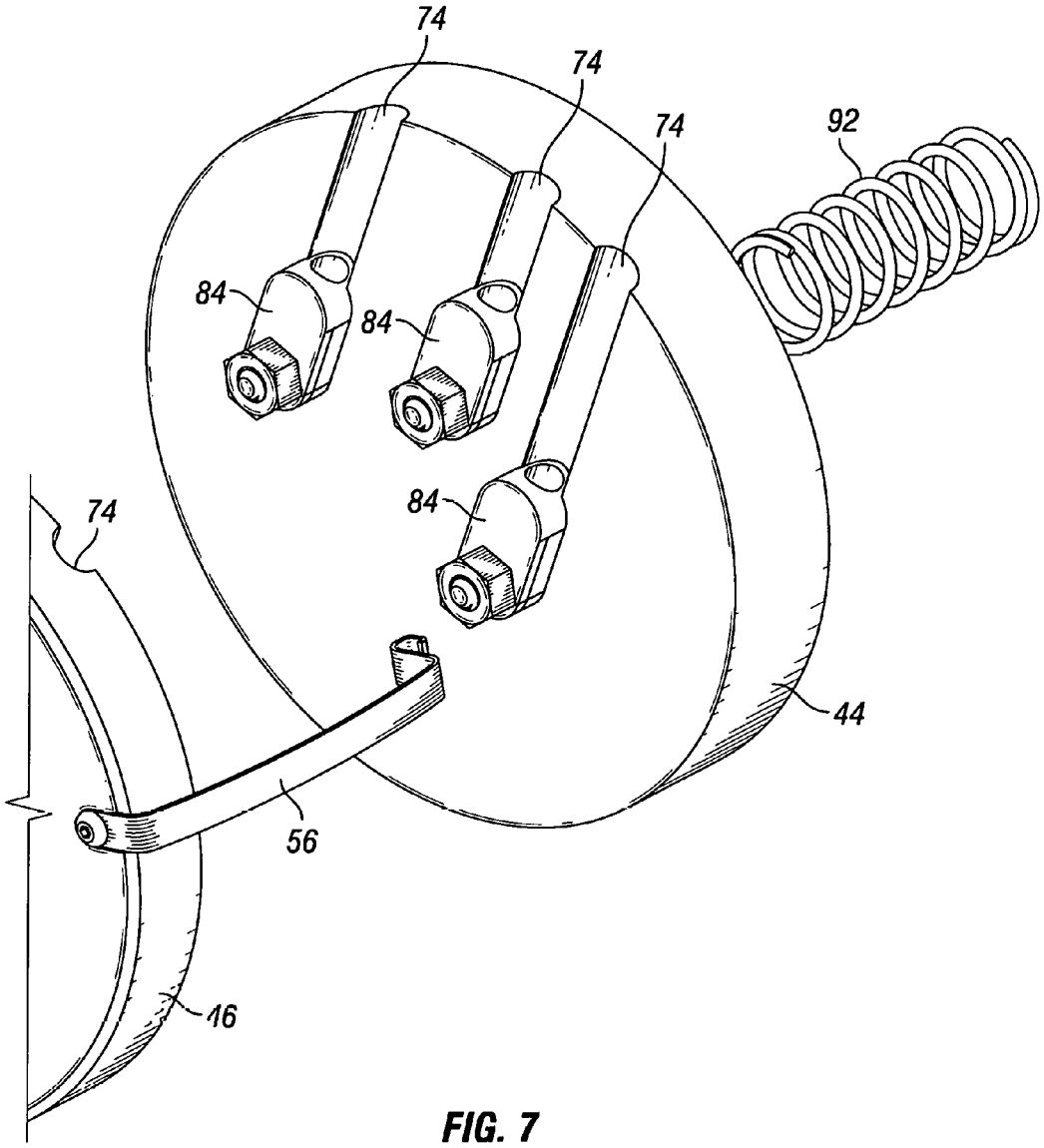
FIG. 7 is a top perspective view of the top lug plate in the top segment of the power wiring adapter.

FIGS. 6-7 are directed to the top segment 36 of the power wiring adapter 24. Electrical lugs 84 for the top segment 36 are mounted on the top side of the top lug plate 44. Male conductor rods 86 extend from the lower surface of the top lug plate 44. The male conductor rods 86 are secured to the electrical lugs 84. The male conductor rods 86 may be made from copper, brass, or other electrical conductive material. When the top segment 36 is secured to the bottom segment 34, the male conductor rods 86 are inserted into female lug extensions 66 to facilitate electrical connection between the bottom segment 34 and the top segment 36. The wire clamping element 88 is accessible from the bottom surface of the top lug plate 44. When an electrical conductor is inserted into the lug 84, the clamping element 88 is screw tightened to secure the conductor in the lug 64. Lug recesses 72 are formed in the bottom of the cover plate 46 and the top of the top lug plate 44 for positioning the lugs 84. Access grooves 74 are also formed in the bottom of the cover plate 46 and the top of the top lug plate 44 to form the apertures 46T, 48T, and 50T to allow the electrical conductors to access the lugs 84. The lower surface of the top lug plate 44 includes three recessed circular areas 90, which accommodate the heads of the three mounting bolts 52. The lower surface of the top lug plate also includes a circular groove 80 to accommodate the top o-ring 78.

A spring 92 or other potential energy element is mounted on the bottom side of the top lug plate 44. When the top segment 36 is positioned above the bottom segment 34 to achieve electrical connectivity, the spring 92 is compressed to provide potential energy for a quick release function. The retention clips are secured about the bottom segment 34 to retain this potential energy. Other retention mechanisms may also be used to control the spring 92 or other potential energy source.

Figure 8:
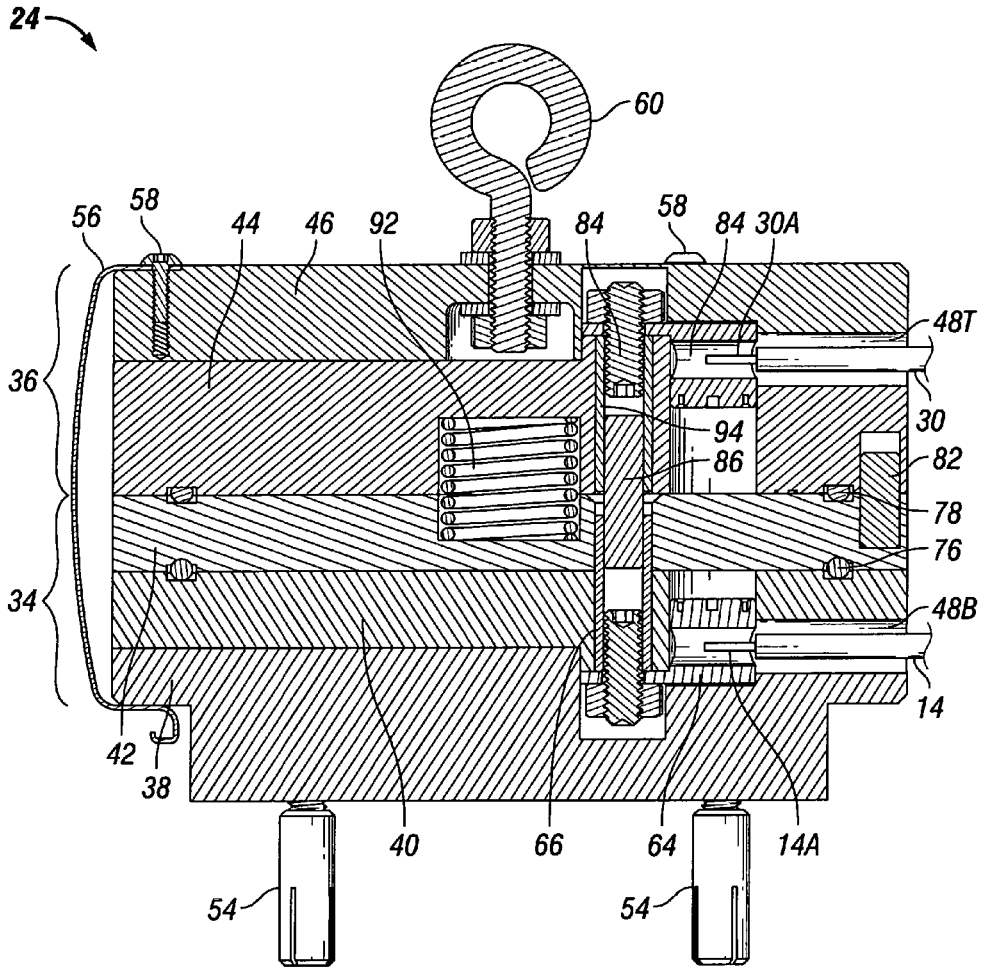
FIG. 8 is a cross sectional view of the power wiring adapter taken along a center diameter of the power wiring adapter.
Figure 9:
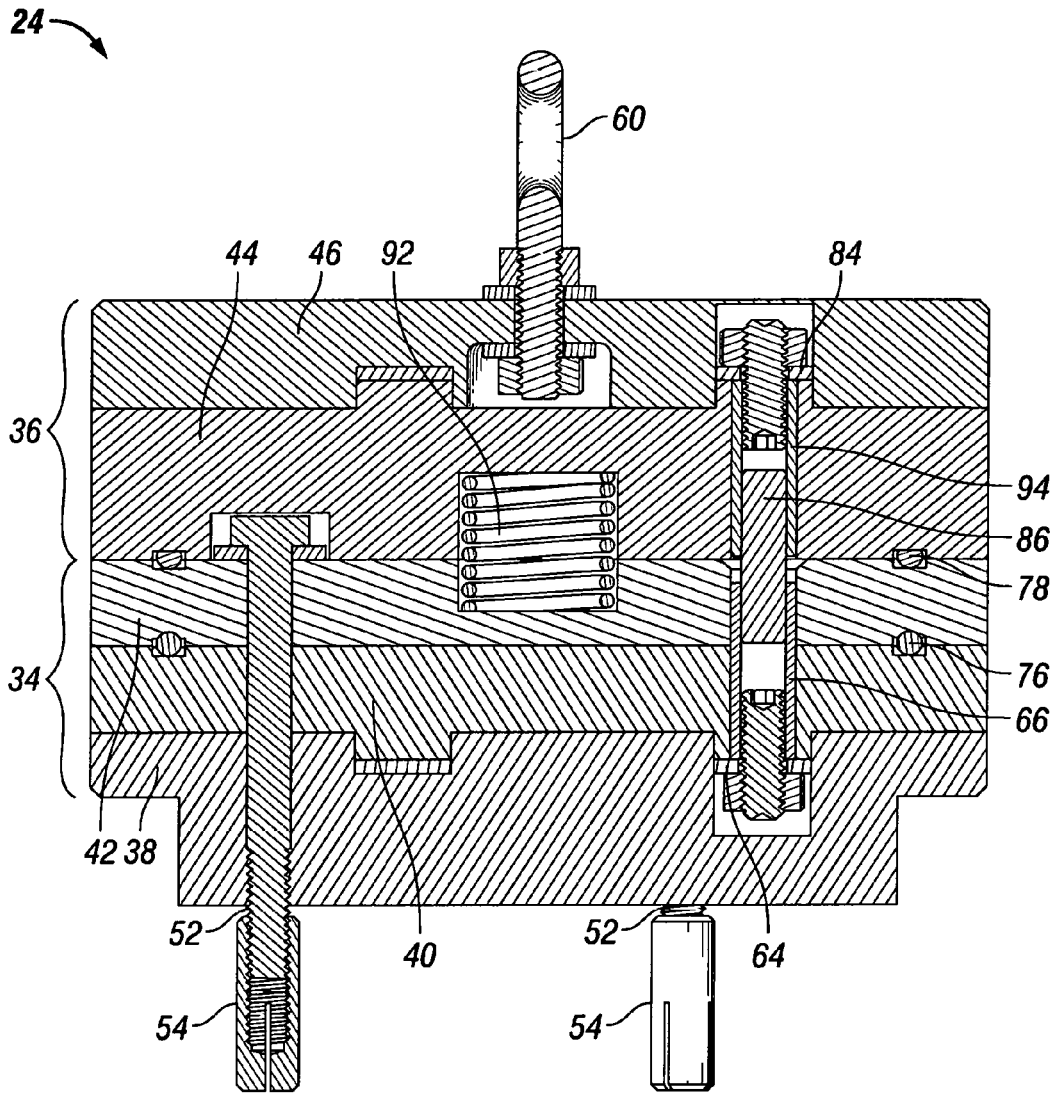
FIG. 9 is a cross sectional view of the power wiring adapter taken along a second center diameter of the power wiring adapter, rotated 90 degrees from FIG. 8.

FIGS. 8-9 show cut away views of the assembled power wiring adapter 24. The spring 92 is compressed and the retention clips 56 are in position to retain the top segment 36 on top of the bottom segment 34. One of the insulated conductors 14A of power wire 14 has been inserted into the aperture 48B and has been secured in the lug 64. One of the insulated conductors 30A of power wire segment 30 has been inserted into aperture 48T and has been secured in the lug 84. Electrical conductivity is provided through the power wiring adapter 24 from insulated conductor 14A to lug 64 to female lug extension 66 to male conductor rod 86 to female lug extension 94 to the lug 84 to the insulated conductor 30A.

In field use, it is preferable that the power wiring adapter 24 be waterproof due to problems caused by exposure to water, such as flood conditions. With the use of the bottom o-ring seal 76 and the top o-ring seal 78, the power wiring adapter 24 is waterproof except for the access provided through the six apertures 46B, 48B, 50B, 46T, 48T 50T. Once the three insulated conductors from power wire 14 have been inserted into the three lugs 64 and the three insulated conductors from the power wire segment 30 have been inserted into the lugs 84, the six apertures 46B, 48B, 50B, 46T, 48T 50T can be sealed by inserting a silicon or other quick-drying sealant (not shown) into the apertures. The sealant can be inserted in the field by a technician using a standard tube of the sealant. The hardened sealant will provide a waterproof seal, but will not damage the insulated conductors or otherwise adversely impact the electrical conductivity.

Once the power wiring adapter 24 is installed in the control box 10, a triggering action removes the inhibiting force and the potential energy is released to separate the top segment 36 from the bottom segment 34. One or more trip wires (not shown) may have one end attached to the anchor bolt 60 and the other end secured an appropriate location in the control box 10. Any type of triggering event, such as an accident which physically moves a trip wire, will pull on the anchor bolt and overcome the retention force of the retention clips 56. At that time, the release of the spring force is triggered, which then causes the top segment 36 to disengage from the bottom segment 34. When an accident or other triggering event occurs, this quick release functionality allows the shear point of the power wiring system to be controlled. The shear point is above ground in the control box 10, where the power wire segment 30 is easier to replace than the power wires 14 which are buried under ground.

The power wiring adapter 24 of the present invention is designed for assembly and installation in the field. The five plates 38, 40, 42, 44, 46 would be packaged individually and provided in a kit. When a technician is ready to install the power wiring adapter 24, three holes are drilled into the concrete pedestal 28. The anchors 54 are inserted into the holes in the concrete and tightened. Once the power wire 14 and the power wire segment 30 are available, the conductors from the power wire 14 are secured in the bottom lug plate 40 and the conductors from the power wire segment 30 are secured in the top lug plate 44. The outer coating at the end of the power wire 14 is stripped off and the insulation at the ends of the conductors is also stripped off by the technician. The insulated conductors include a hot—power conductor, a common—neutral conductor, and a ground wire. Each of the conductors is color-coded per the applicable electrical wiring standards. Each of the three conductors of power wire 14 is connected to an electrical lug 64 in the bottom lug plate 40, and the conductors are positioned in the access groove 74 for one of the apertures 46B, 48B, and 50B of the bottom segment 34. The power wire segment 30 extending from the power system components 20 to the power wiring adapter 24 has the end of the segment 30 prepared in a similar manner. The conductors are secured to an electrical lug 64 in the top lug plate 44 and are positioned in the access groove 74 for one of the apertures 46T, 48T, and 50T of the top segment 36. For electrical continuity purposes, the conductors of power wire 14 positioned in the apertures 46B, 48B and 50B must match the corresponding conductors of the power wire segment 30 positioned in the apertures 46T, 48T and 50T. For example, if the hot—power conductor is positioned in aperture 46B, the hot—power conductor would also be positioned in 46T.

After the conductors from power wire 14 are secured in the electrical lugs 64 of the bottom lug plate 40, the technician may proceed with the assembly of the base plate 38, the bottom lug plate 40, and the center plate 42. The screws 62 are used to secure the center plate 42 to the bottom lug plate 40. The mounting bolts 52 extend through apertures 98 on the bottom lug plate 40 and apertures 96 on the base plate 38. The mounting bolts 52 are tightened into the adapters 54, thereby securing the three plates 38, 40, 42 of the bottom segment 34 to the concrete. Once the bottom segment 34 is assembled, the silicon sealant can be injected into the apertures 46B, 48B, 50 B to seal the apertures.

After the conductors from the power line segment 30 are secured in the electrical lugs 64 of the top lug plate 44, the technician may proceed with the final assembly of the power wiring adapter 24. The top lug plate 44 is positioned on top of the center plate 42 such that the male conductor rods 86 are inserted into female lug extensions 66. The alignment pins 82 assist in the positioning process. The spring 92 is positioned in the recess of the center plate 42. The retention clips 56 can be pre-attached to the cover plate 46 or can be attached to the cover plate 46 in the field. The cover plate 46 is positioned on top of the top lug plate 44 such that the grooves 74 form the top apertures 46T, 48T, 50T. Once the top lug plate 44 and the cover plate 46 are properly aligned, the field technician pushes downward on the cover plate 46 until the retention clips 56 are secured around the base plate 38. The spring 92 is compressed to provide potential energy. Once the retention clips 56 are secured, the one or more trip wires can be attached to the anchor bolt 60. Silicon sealant can also be injected into the apertures 46T, 48T, 50T.

FIGS. 10-16 show the various elements of the control wiring adapter 26. The control wiring adapter 26 may be made of any material, including metal, plastic, or rubber. The preferred material and methodology for making the control wiring adapter 26 is a molded, high density PVC plastic or other similar non-conducting material. The control wiring adapter 26 has two main components, a bottom segment 100 and a top segment 102. The bottom segment 100 includes two plates, a base plate 104, and a bottom connector plate 106. The top segment 102 includes two plates, the top connector plate 108 and the cover plate 110. The control wiring adapter 26 is furnished to technicians in the field as a kit, with each of the four plates packaged individually within the kit for assembly at the control box 10.

Figure 10:
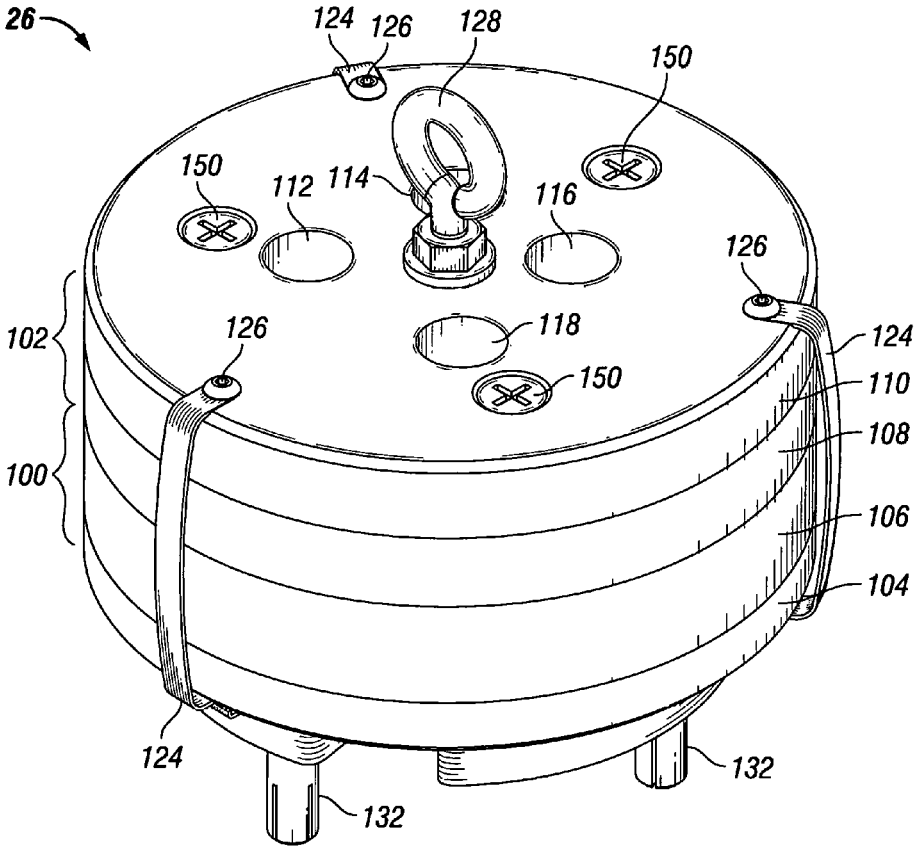
FIG. 10 is a top perspective view of a control wiring adapter with retention clips securing the top segment to the bottom segment of the control wiring adapter.

FIG. 10 shows the control wiring adapter 26 in assembled form. There are four apertures 112, 114, 116, 118 which extend vertically through the control wiring adapter 26. When the one or more control wires 18 exit the conduit 16 (not shown in FIG. 10), the outer coating at the end of the control wire 18 is stripped off and the insulation at the ends of the conductors is also stripped off by the technician. The insulated conductors include two or more low voltage conductors. Each of the conductors is color-coded per the applicable electrical wiring standards. Each of the control wires 18 is allocated to one of the apertures 112, 114, 116, 118 for connection to bottom female connectors 120 in the bottom segment 100 of the control wiring adapter 26. The one or more control wire segments 32 extending from the control system components 22 to the control wiring adapter 26 has the end of the segment 32 prepared in a similar manner. The conductors for control wire segments 32 are allocated to one of the apertures 112, 114, 116, 118 for connection to top male connectors 122 in the top segment 102. For electrical continuity purposes, the conductors of control wires 18 positioned in the apertures 112, 114, 116, 118 must match the corresponding conductors of the control wire segments 32 positioned in the apertures.

FIGS. 10-16 show four apertures 112, 114, 116, 118 with four sets of connectors 120, 122. But the number of apertures in an adapter can be increased by increasing the circumference of the control wiring adapter 26 and forming more vertical apertures in the control wiring adapter 26. The bottom female connectors 120 and the top male connectors 122 are shown as three pin connectors. Alternative connectors with greater or fewer pins may be used in the control wiring adapter 26.

Three mounting bolts 130 extend from the bottom surface of base plate 104, which are used to secure the bottom segment 100 of the control wiring adapter 26 to the concrete pedestal 28 at the bottom of control box 10. Three holes are drilled into the concrete pedestal 28. The anchors 132 are inserted into the holes in the concrete. The plates 104, 106, 108, 110 are assembled in the field and silicone sealed at the time of installation. The mounting bolts 30 extend through the bottom connector plate 106 and the base plate 104 to secure the bottom segment 100 to the concrete pedestal 28.

The retention clips 124 are used to secure the top segment 102 to the bottom segment 100. The retention clips 124 are fastened to the top of the cover plate 110 using screws 126 or other similar fasteners. The retention clips 124 are made of aluminum or other flexible metal. The free end of the retention clips 124 includes a hook which is positioned to engage the flanged surface of the base plate 104. The retention clips 124 are sized so that the clips 124 have sufficient force to secure the top segment 102 to the bottom segment 100.

An adapter ring, such as anchor bolt 128, is secured in the top surface of the cover plate 110. One or more trip wires (not shown) are connected to the anchor bolt 128.

Figure 11:
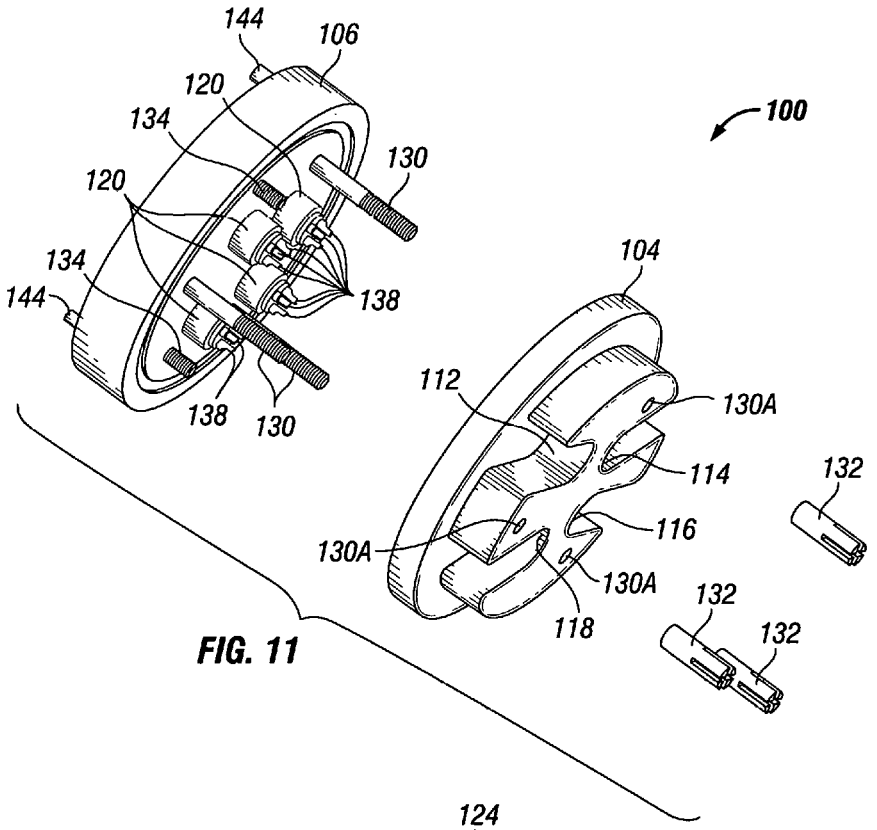
FIG. 11 is an exploded, bottom perspective view of the two plates of the bottom segment of the control wiring adapter.

FIG. 11 provides an exploded view of the bottom segment 100. The mounting bolts 130 extend from the top of the bottom connector plate 106 through the apertures 130A in base plate 104 into the anchors 132. The screws 134 are used to secure the bottom connector plate 106 to the base plate 104.

The bottom female connectors 120 for the bottom segment 100 are mounted in apertures 112, 114, 116, 118 of the bottom connector plate 106. The bottom female connectors 120 have three openings on their top surface to accept the male contacts 136 of the top male connectors 122. The lower side of the bottom female connectors 120 includes three pins 138 on each connector 120 to which the conductors of the control wire 18 may be attached. C-rings (not shown) are used to secure bottom female connectors 120 to the bottom connector plate 106.

The control wiring adapter 26 includes three o-rings 140 positioned in circular grooves 142 formed on the inner surfaces of the four plates 104, 106, 108, 110. The o-rings 140 provide a water tight seal for the connectors 120, 122 on the inside of the control wiring adapter 26.

Positioning pins 144 are secured to the upper surface of the bottom connector plate 106. The positioning pins 144 are used to assure proper electrical conductivity and mechanical alignment when the top segment 102 is secured to the bottom segment 100. The drawings show that the female connector 120 is in the bottom segment 100 and the male connectors 122 are in the top segment 102, but the male-female features could be switched, such that the female connectors 120 would be in the top segment 102.

Figure 12:
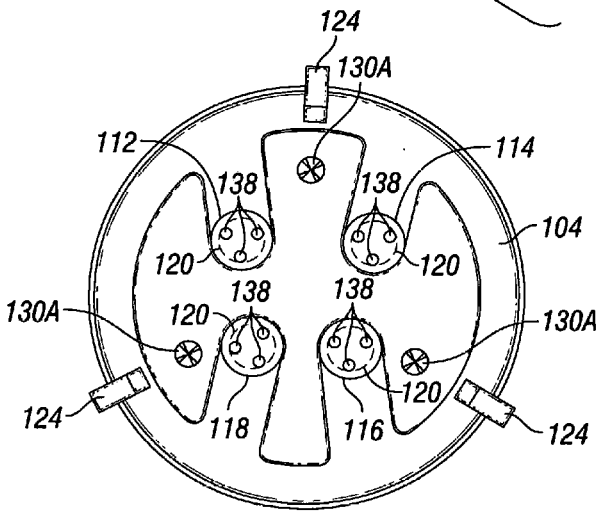
FIG. 12 is a bottom plan view of the control wiring adapter showing bottom of the base plate and the female connectors positioned in the four vertical apertures of the base plate.
Figure 17:
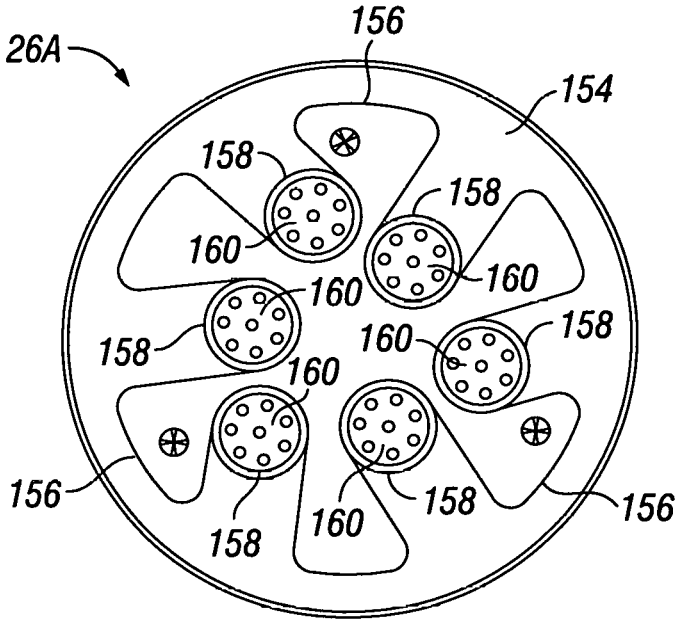
FIG. 17 is an alternative bottom plan view of the control wiring adapter showing six vertical apertures in the bottom of the base plate and the female connectors positioned in the six vertical apertures.

FIG. 12 shows a bottom plan view of base plate 104 with the retention clips 124 in place for the control wiring adapter 26. This view shows the three mounting bolt apertures 130A (without mounting bolts 130) positioned in the extended platform of the base plate 104. The extended platform also provides the control wires 18 (not shown in FIG. 12) with side access to the bottom female conductors 120 positioned in the four vertical apertures 112, 114, 116, and 118. The control wires 18 are attached to the pins 138 of the bottom female conductor. FIG. 17 shows an alternative aperture design for a control wiring adapter 26A. This bottom view of base plate 154 shows the three mounting bolt apertures 156. In this design, the number of vertical apertures 158 extending through all of the plates of the control wiring adapter 26A has been increased from four to six. The bottom female conductors 160 also show an alternative pin design.

Figure 13:
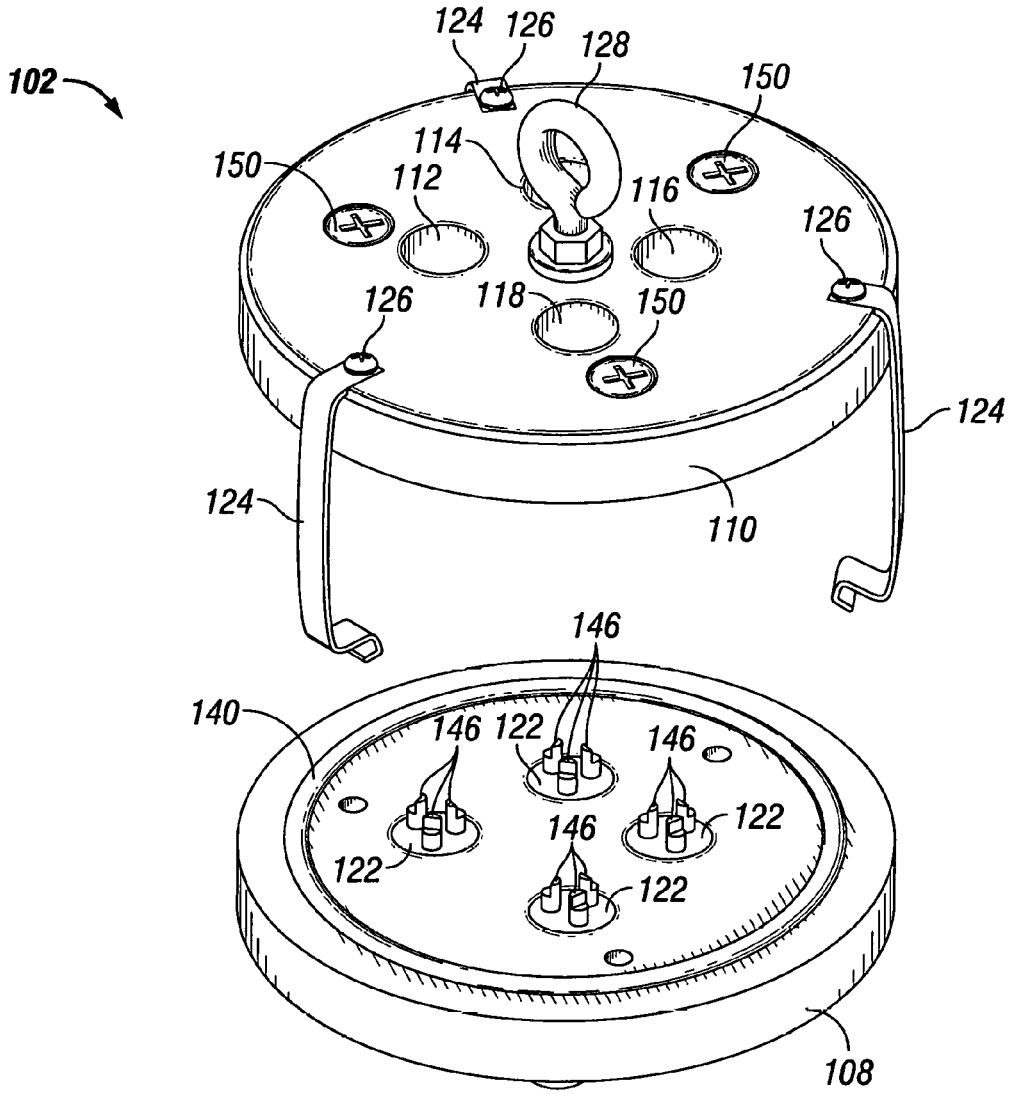
FIG. 13 is an exploded, top perspective view of the two plates of the top segment of the control wiring adapter.
Figure 14:
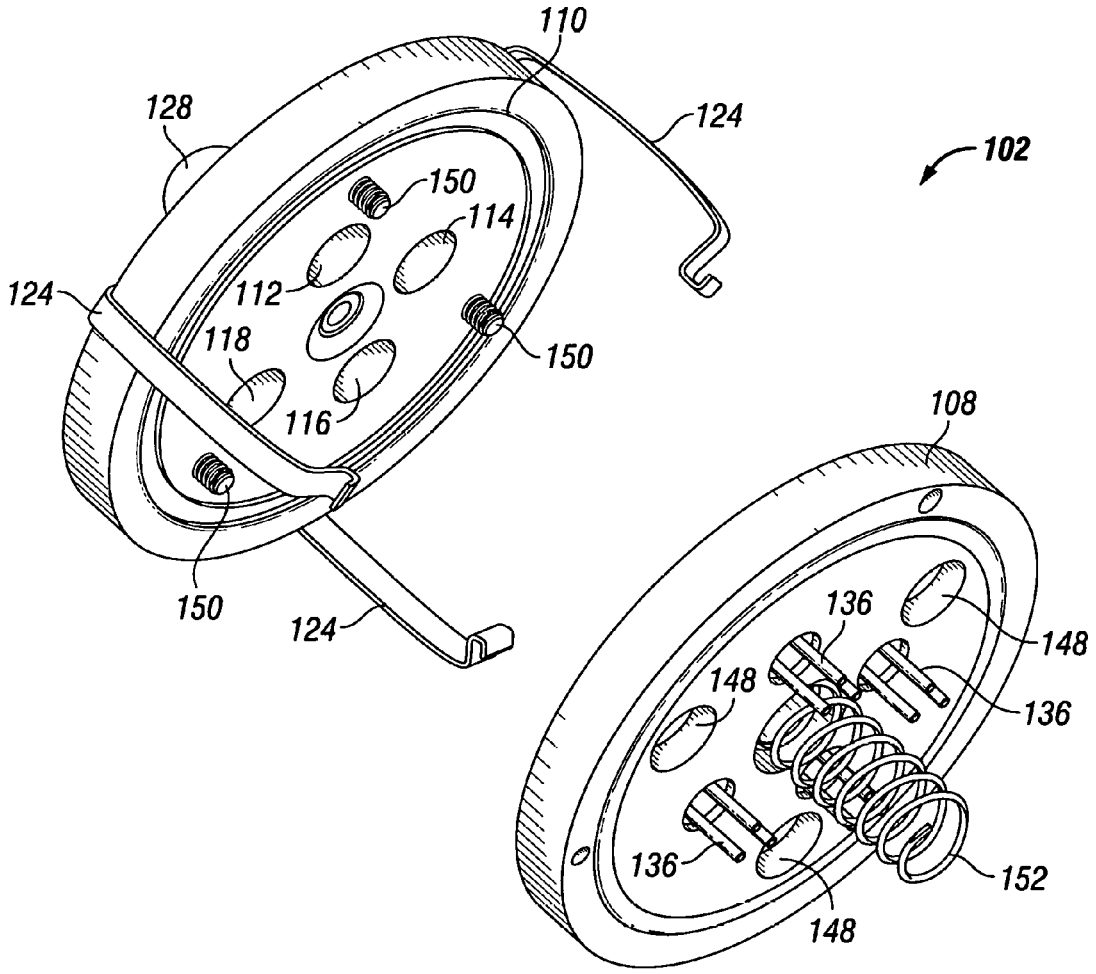
FIG. 14 is an exploded, bottom perspective view of the two plates of the top segment of the control wiring adapter.
Figure 15:
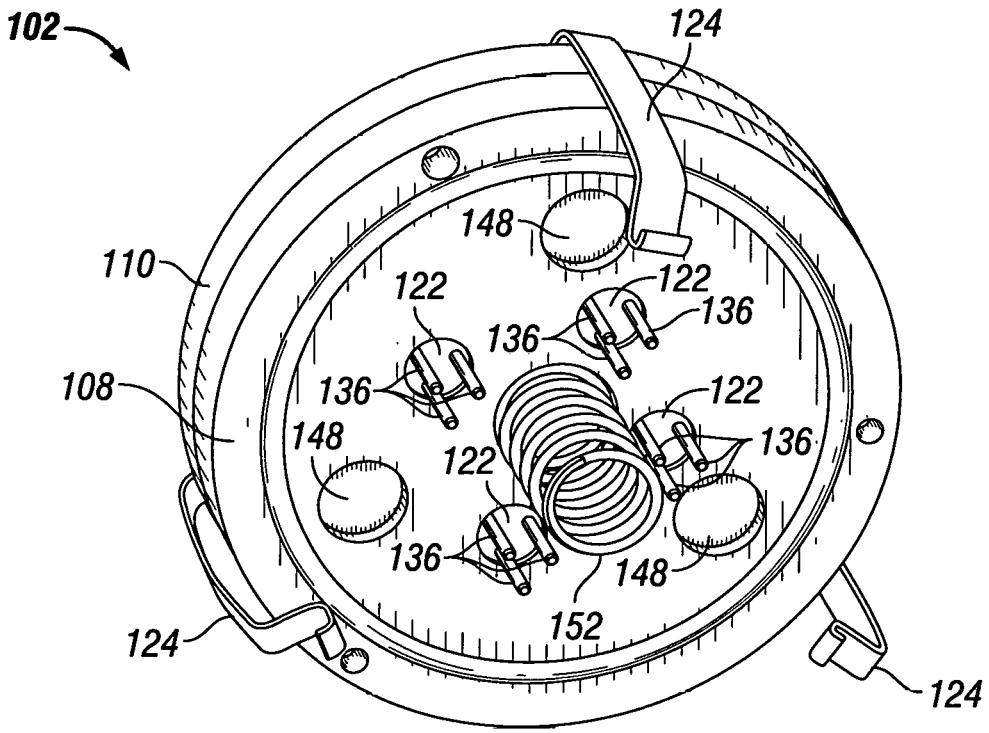
FIG. 15 is a bottom perspective view of the top segment of the control wiring adapter.

FIGS. 13-15 are directed to the top segment 102 of the control wiring adapter 26. Top male connectors 122 are mounted in apertures 112, 114, 116, 118 of the top connector plate 108. Male contacts 136 extend from the lower surface of the top connector plate 108. The male contacts 136 may be made from copper, brass, or other electrical conductive material. When the top segment 102 is secured to the bottom segment 100, the male contacts 136 are inserted into female connector 120 to facilitate electrical connection between the bottom segment 100 and the top segment 102. The upper side of the top male connectors 122 includes three pins 146 on each connector 122 to which the conductors of the control wire segments 32 may be attached. C-rings (not shown) are used to secure top male connectors 122 to the top connector plate 108.

The screws 150 are used to secure the cover plate 110 to the top connector plate 108. The lower surface of the top connector plate 108 includes three recessed circular areas 148, which accommodate the heads of the three mounting bolts 130.

A spring 152 or other potential energy element is mounted on the bottom side of the top connector plate 108. When the top segment 102 is positioned above the bottom segment 100 to achieve electrical connectivity, the spring 152 is compressed to provide potential energy for a quick release function. The retention clips 124 are secured about base plate 104 of the bottom segment 100 to retain this potential energy. Other retention mechanisms may also be used to control the spring 152 or other potential energy source.

Figure 16:
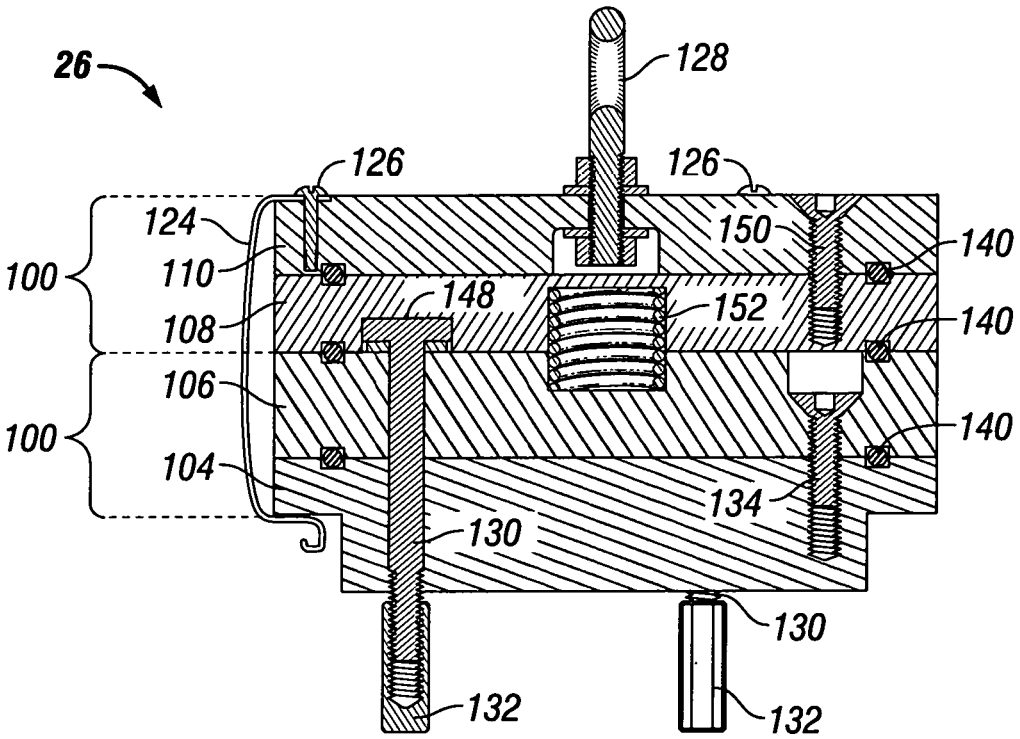
FIG. 16 is a cross sectional view of the control wiring adapter taken along a center diameter of the control wiring adapter.

FIG. 16 shows a cut away view of the assembled control wiring adapter 26. The spring 152 is compressed and the retention clips 124 are in position to retain the top segment 102 on top of the bottom segment 100 with sufficient force to create a sealed mating. In field use, it is preferable that the control wiring adapter 26 be waterproof due to problems caused by exposure to water, such as flood conditions. With the use of the three o-ring seals 140, the control wiring adapter 26 is waterproof except for the access provided through the four apertures 112, 114, 116, 118. Once the insulated conductors from control wires 18 have been connected to the pins 138 for the bottom female connectors 120 and the insulated conductors from the control wire segments 32 have been connected to the pins 146 for the top male connectors 122, the for vertical apertures 112, 114, 116, 118 can be sealed by injecting a silicon or other quick-drying sealant (not shown) into the top opening and the bottom opening of the apertures. The sealant can be inserted in the field by a technician using a standard tube of the sealant. The hardened sealant will provide a waterproof seal, but will not damage the insulated conductors or otherwise adversely impact the electrical conductivity.

Once the fully assembled control wiring adapter 26 is installed in the control box 10, a triggering action removes the inhibiting force and the potential energy is released to separate the top segment 102 from the bottom segment 34. One or more trip wires (not shown) may have one end attached to the anchor bolt 128 and the other end secured an appropriate location in the control box 10. Any type of triggering event, such as an accident which physically moves a trip wire, will pull on the trip ring anchor bolt 128 and overcome the retention force of the retention clips 124. At that time, the release of the spring force is triggered, which then causes the top segment 102 to disengage from the bottom segment 100 in a straight vertical lift motion. The alignment pins also assist in the vertical lift motion. When an accident or other triggering event occurs, this quick release functionality allows the shear point of the control wiring system to be controlled. The shear point is above ground in the control box 10, where the control wire segment 32 is easier to replace than the control wires 18 which are buried under ground. Control wire segments 32 and other wires within the control box 10, and any devices that are connected to the wires will typically incur less damage because of the shear point control.

The control wiring adapter 26 of the present invention is designed for assembly and installation in the field. The four plates 104, 106, 108, 110 would be packaged individually and provided in a kit. When a technician is ready to install the control wiring adapter 26, three holes are drilled into the concrete pedestal 28. The anchors 132 are inserted into the holes in the concrete. Once the control wires 18 and the control wire segments 32 are available, the conductors from the control wires 18 are available for connection to the pins 138 of the bottom connector plate 106 and the conductors from the power wire segments 32 are available for connection to the pins 146 of the top connector plate 108.

The conductors from control wires 18 are fed through apertures 112, 114, 116, 118 of the base plate 104 and are secured to the pins 138 of the female connectors 120 positioned in the bottom connector plate 106. Then the technician may proceed with the assembly of the base plate 104 and the bottom connector plate 106. The screws 134 are used to secure the bottom connector plate 106 to the base plate 104 to form the bottom segment 100. Silicon sealant may be injected into the aperture 112, 114, 116, 118 before the bottom segment 100 is secured to the concrete. The mounting bolts 130 extend through apertures 130A on the base plate 104. The mounting bolts 134 are screwed into the anchors 132, thereby securing the two plates 104, 106 of the bottom segment 100 to the concrete pedestal 28.

In the field assembly process, the conductors from the control line segments 30 are fed through apertures 112, 114, 116, 118 of the cover plate 110 and are secured to the pins 146 of the top male connectors 122 positioned in the top connector plate 108. After the conductors are secured, the technician may proceed with the final assembly of the control wiring adapter 26. The cover plate 110 is secured to the top connector plate 108 by the screws 150, which now forms the top segment 102. Silicon sealant may be injected into the aperture 112, 114, 116, 118 before the top segment 102 is secured to the bottom segment 100. The top segment 102 is positioned on top of the bottom connector plate 106 of the bottom segment 100 such that the male contacts 136 are inserted into bottom female connectors 120. The alignment pins 144 assist in the positioning process during assembly and in the vertical lift motion when a triggering event occurs. The spring 152 is positioned in the recess of the bottom connector plate 120. The retention clips 124 can be pre-attached to the cover plate 110 or can be attached to the cover plate 110 in the field. Once the top segment 102 is properly aligned, the field technician pushes downward on the cover plate 110 until the retention clips 124 are secured around the base plate 104. The spring 152 is compressed to provide potential energy. Once the retention clips 124 are secured, the one or more trip wires can be attached to the anchor bolt 128.

When new control boxes 10 are to be installed in the field, the top segment 102 can be pre-wired prior to installation. When an accident occurs and a totally new control box 10 is required to replace a damaged control box, the pre-wiring of the top segment 102 helps to reduce the installation time of the new control box 10.

Any type of triggering event, such as an accident which physically moves a trip wire, will pull on the trip ring, such as anchor bolt 128, and overcome the retention force of the retention clips 124. At that time, the release of the spring force is triggered, which then causes the top segment 102 to disengage from the bottom segment 100. This quick release functionality allows the shear point of the control wiring system to be controlled.

The power wiring adapter 24 includes the lugs 64 which are designed to carry the 120 volt or 240 volt AC power to the power system elements 20 in the control box 10. The control wiring adapter 26 is provided with connectors suitable for the low voltage power used for control purposes by the control system elements 22. The multi-plate design used in both the power wiring adapter 24 and the control wiring adapter 26 could be used with other connectors and other aperture arrangements for other applications which would benefit from shear point control in a wiring system. Such applications could include, for example, coaxial cables for cameras and cable television circuit protection.

Many different arrangements of the various components depicted, as well as components not shown, are possible without departing from the scope of the claims below. Embodiments of our technology have been described with the intent to be illustrative rather than restrictive. Alternative embodiments will become apparent readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A wiring adapter having a quick release functionality for controlling the shear point of a wiring system, said wiring adapter being located in proximity to a conduit opening through which incoming wires are extended, said wiring adapter comprising:

a bottom segment formed from two or more bottom plates, said bottom segment including a plurality of mounting bolts to secure the wiring adapter to a fixed surface in proximity to the conduit opening, and including one or more female connectors positioned between the bottom plates;

a plurality of apertures formed in the bottom segment to provide access to the female connectors, said plurality of apertures including an incoming aperture for each of the female connectors to facilitate connection of the incoming wires to the female connectors, and including a connection aperture for each of the female connectors, said connection aperture formed in a top surface of the bottom segment to facilitate access to the female connectors;

a top segment formed from two or more top plates, said top segment including one or more male connectors positioned between the top plates;

a plurality of apertures formed in the top segment to provide access to the male connectors, said plurality of apertures including an outgoing aperture for each of the male connectors to facilitate connection of outgoing wire segments to the male connectors, and including a connection aperture for each of the male connectors, said connection aperture formed in a bottom surface of the top segment to facilitate access to the male connectors; and a quick release mechanism to selectively secure the male connectors in the bottom surface of the top segment to the female connectors in the top surface of the bottom segment, said quick release mechanism including a potential energy storing mechanism positioned between the top segment and the bottom segment, and including one or more retention clips extending from an outer surface of the top segment to an outer surface of the bottom segment, whereby conductivity is achieved from the incoming wires to the female connectors to the male connectors and then to the outgoing wire segments, and whereby a triggering of the quick release mechanism will cause the top segment of the wiring adapter disengage from the bottom segment.

2. The wiring adapter of claim 1, wherein the potential energy storage mechanism is a spring.

3. The wiring adapter of claim 1, wherein the plurality of apertures in the bottom segment are formed vertically within bottom plates and wherein the plurality of apertures in the top segment are formed vertically within the top plates, whereby the plurality of apertures of the bottom segment are aligned with the corresponding plurality of apertures of the top segment.

4. The wiring adapter of claim 1, wherein the plurality of apertures in the bottom segment are formed horizontally within bottom plates and wherein the plurality of apertures in the top segment are formed horizontally within the top plates.

5. The wiring adapter of claim 4, wherein the plurality of horizontal apertures in the bottom segment are formed by a groove in the top surface of a first bottom plate and a corresponding groove in the bottom surface of the second bottom plate, and wherein the plurality of horizontal apertures in the top segment are formed by a groove in the top surface of the first top plate and a corresponding groove in the bottom surface of a second top plate.

6. The wiring adapter of claim 1, wherein said female connectors and said male connectors are power lugs suitable for an alternating current power supply.

7. The wiring adapter of claim 1, wherein said female connectors and said male connectors are low voltage connectors suitable for multi-conductor control wires.

8. The wiring adapter of claim 1, including an o-ring positioned between the bottom plates of the bottom segment around the outer circumference of the bottom plates, and including an o-ring positioned between the top plates of the top segment around the outer circumference of the top plates, and including an o-ring in the top surface of the bottom segment to engage the bottom surface of the top segment when the top segment is secured to the bottom segment.

9. The wiring adapter of claim 1, including a sealant positioned in the plurality of apertures formed in the bottom segment and said sealant positioned in the plurality of apertures formed in the top segment.

10. The wiring adapter of claim 1, including a quick release anchor mechanism secured to the top segment, whereby one or more trip wires are attached to the quick release anchor mechanism.

11. The wiring adapter of claim 1, including one or more positioning pins extending from the top surface of the bottom segment and including one or more corresponding positioning apertures formed in the bottom surface of top segment, whereby the positioning pins are inserted into the positioning apertures when the top segment is secured to the bottom segment.

12. The wiring adapter of claim 1, including a plurality of concrete anchors to secure the plurality of mounting bolts to a concrete pedestal in a control box.

13. A method for connecting, in a control box, a wire having a plurality of conductors to a corresponding wire segment having a plurality of conductors using a wiring adapter to provide shear point control, such that when the control box is damaged and stress is applied to the wire and the wire segment, the shear point for the stressed wire and wire segment occurs at the wiring adapter, the method comprising:

creating, in the control box, a plurality of mounting holes in a secure surface in proximity to a conduit opening by which the wire enters the control box;

positioning the conductors of the wire in a plurality of apertures formed in a bottom segment of the wiring adapter, said bottom segment including at least two freestanding bottom plates;

attaching the conductors of the wire to a corresponding number of female connectors secured in the apertures of the bottom segment of the wiring adapter;

securing the freestanding bottom plates to each other to complete the bottom segment;

positioning the conductors of the wire segment in a plurality of apertures formed in a top segment of the wiring adapter, said top segment including at least two freestanding top plates;

attaching the conductors of the wire segment to a corresponding number of male connectors secured in the apertures of the top segment of the wiring adapter;

securing the freestanding top plates to each other to complete the top segment;

mounting the bottom segment in the mounting holes;

aligning the top segment over the bottom segment so that the male connectors are aligned with the female connectors, and positioning a spring between the top segment and the bottom segment;

applying force to the top of the top segment until the spring is compressed and the male connectors are engaging the female connectors;

securing the retention clips about the top segment and the bottom segment so that the male connectors are still engaging the female connectors, and securing one or more trip wires to a quick release anchor mechanism secured to the top segment of the wiring adapter.

14. The method of claim 13, wherein the wire and the wire segment are power wires having three conductors for use with alternating current power supply, and including the additional step of stripping insulation from the three conductors when attaching the conductors to the female connectors and the male connectors.

15. The method of claim 13, wherein the wire and the wire segment are control wires having a plurality conductors for use with a low voltage power supply, and including the additional step of stripping insulation from the plurality of conductors when attaching the conductors to the female connectors and the male connectors.

16. The method of claim 13, including the additional step of injecting sealant into the plurality of apertures formed in the bottom segment and into the plurality of apertures formed in the top segment of the wiring adapter.

17. The method of claim 13, including the additional step of securing the retention clip to the top segment using a fastener and flexing the free end of the retention clip about bottom segment to retain the top segment to the bottom segment.

18. The method of claim 13, including the additional steps of inserting an o-ring between the two freestanding bottom plates when securing the two bottom plates to each other, and of inserting an o-ring between the two freestanding top plates when securing the two plates to each other.

19. The method of claim 13, including the additional step of inserting an o-ring between the top segment and the bottom segment when aligning the top segment over the bottom segment.

* * * * *